US005129308A

United States Patent [19]

Fuereder et al.

[11] Patent Number: 5,129,308

[45] Date of Patent: Jul. 14, 1992

[54] COMBAT VEHICLE WITH EXTENDIBLE COMBAT PLATFORM

[76] Inventors: Georg F. Fuereder, Dresdener Ring 5, Wiesbaden D6200; Manfred Trinkaus, Hauptstr. 13, Heltersberg D6751, both of Fed. Rep. of Germany

[21] Appl. No.: 495,842

[22] Filed: Mar. 19, 1990

[30] Foreign Application Priority Data

Mar. 21, 1989 [DE] Fed. Rep. of Germany ..... 3909490
Sep. 25, 1989 [DE] Fed. Rep. of Germany ..... 3931908

[51] Int. Cl.[5] ..... F41A 23/20

[52] U.S. Cl. ..... 89/36.15; 89/41.18; 89/134

[58] Field of Search ..... 89/1.802, 1.815, 36.15, 89/38, 39

[56] References Cited

U.S. PATENT DOCUMENTS

| | | | |
|---|---|---|---|
| 650,758 | 5/1900 | Lake | 89/36.15 |
| 1,399,395 | 12/1921 | Moran | 89/38 |
| 2,348,796 | 5/1944 | Ferwerda et al. | 89/36.15 |
| 2,826,960 | 3/1958 | Schiavi | 89/1.815 |
| 3,459,100 | 8/1969 | Pfister | 89/1.815 |
| 3,466,969 | 9/1969 | Stangl et al. | 89/1.815 |
| 3,526,166 | 9/1970 | Pfister | 89/1.802 |
| 3,757,635 | 9/1973 | Hickerson et al. | 89/36.15 |
| 4,386,848 | 6/1983 | Clendenin et al. | 89/36.15 |

FOREIGN PATENT DOCUMENTS

| | | | |
|---|---|---|---|
| 2205826 | 8/1973 | Fed. Rep. of Germany | 89/38 |
| 2357805 | 5/1975 | Fed. Rep. of Germany . | |
| 2622995 | 1/1977 | Fed. Rep. of Germany . | |
| 2945278 | 5/1981 | Fed. Rep. of Germany . | |
| 3524244 | 1/1987 | Fed. Rep. of Germany . | |
| 347472 | 3/1905 | France | 89/38 |

OTHER PUBLICATIONS

Von Hasso Erb, Armada International, Jun. 1982, pp. 22–24.

*Primary Examiner*—Stephen C. Bentley
*Attorney, Agent, or Firm*—Jennings, Carter, Thompson & Veal

[57] ABSTRACT

A combat vehicle utilization system including a plurality of extensible elevating members each adapted for mounting to a combat vehicle at a first end and carrying a combat platform at a second end is utilized to increase armament and effectiveness of a combat vehicle whereby the vehicle is able to target and combat a plurality of targets in both aerial and ground elevations and at varying directions.

3 Claims, 8 Drawing Sheets

1
2
3
2a
3a 3
2
5
2a
3a 3a
2a
1
2
3

3
4
2
2a
3a
4a
1

Fig. 8
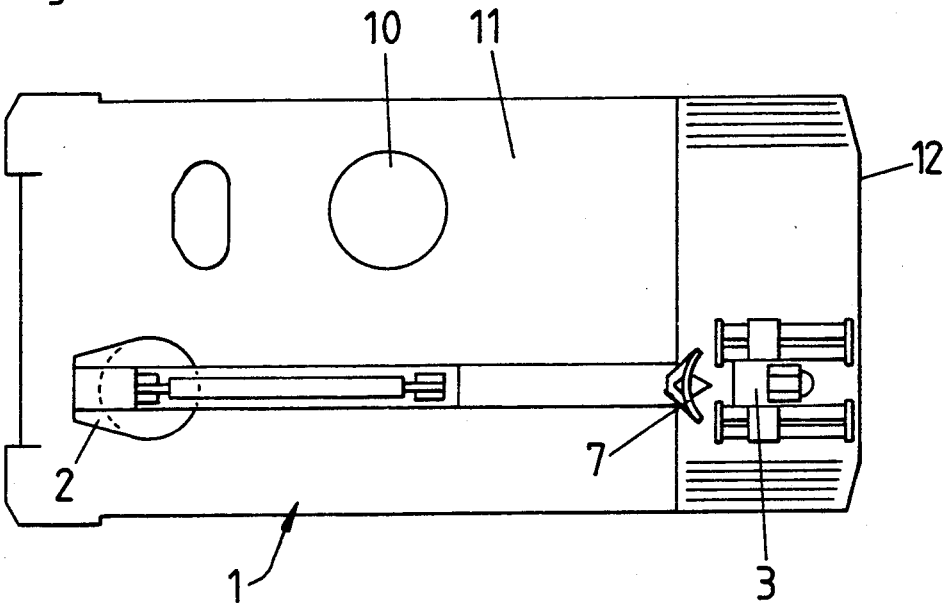
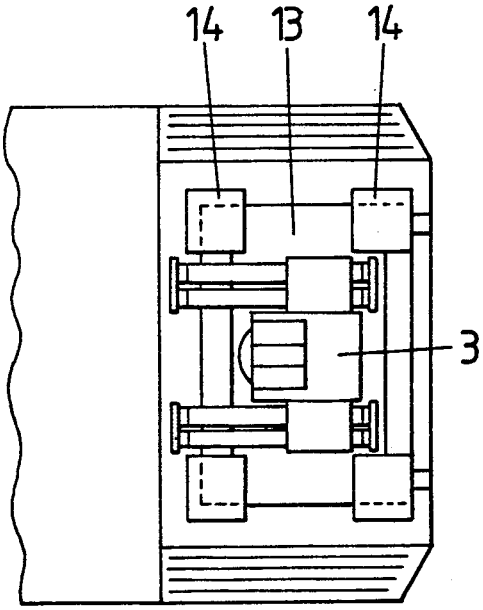
Fig. 9
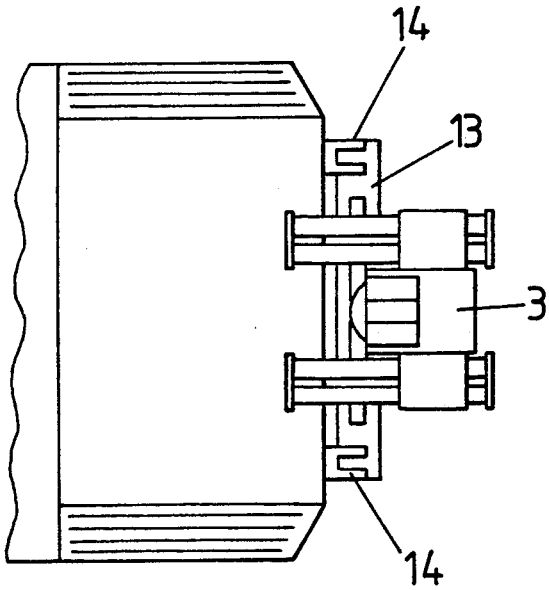
Fig. 10

COMBAT VEHICLE WITH EXTENDIBLE COMBAT PLATFORM

FIELD OF THE INVENTION

The present invention relates to military combat vehicles and more particularly to military vehicles having a plurality of weapons or sensors located on the booms or arms supported on the main carriage of the vehicle. In the even greater particularity the present invention relates to combat vehicles wherein a plurality of extended booms are utilized to deploy weapons and sensors at elevations and azimuths relative to the main frame while in a combat mode.

BACKGROUND OF THE INVENTION

Military combat vehicles with manned and unmanned combat platforms which can be elevated have been suggested in the early seventies in several variants. Eg. DE-Osen 22 05 826, 2357805, 2945278, which show light vehicles without armor, with raiseable unmanned platforms or U.S. Pat. No. 3757635, DE-OSen 2622995 and 3524244 as well as DE-PS 3120338 which shows an armored combat vehicle with a raisable unmanned combat platform plus an additional raiseable set of visionics. These three basic types which have evolved during the last few years have since been further developed and refined. All of these are based on the following military recognition: "with height one gains depth". Furthermore, they offer the possibility to keep the vehicle and crew under cover and expose only the weapons and observation system to direct enemy fire.

The main purpose of vehicles with raiseable combat platforms is seen in their deployment against massively attacking tanks and their possible helicopter-escorts. For this reason armored, and preferably chain equipped, vehicles are being proposed for carriers of combat platforms and their elevating mechanisms. For instance, Hasso Erb, "extendible anti-tank and observation platform" in "Armada International" 6/1982 suggests to re-equip combat tanks or similar slated for retirement, for this purpose.

SUMMARY OF THE INVENTION

It is the object of the present invention to provide a combat vehicle having two elevating mechanisms and combat platforms which can be deployed independently from each other and are thus capable of combat against several aerial and ground targets simultaneously in different directions and at different ranges from partially or fully covered positions wherein the vehicle itself remains out of the line of fire of the target. Another object of the present invention is to provide a plurality of elevated mechanisms with combat platforms whereby multiple armaments may allow more flexible combined or separate deployment of available weapons against the enemy. Yet another object of the invention is to provide conventional fighting vehicles with the ability to be upgraded and modernized utilizing an armament set comprising a movable boom and a combat platform.

These and other objects are advantageously achieved in the present invention through the use of two independently maneuverable combat platforms at the upper end of two separate omni-directionally movable elevating mechanisms, which are joined at their lower end to a vehicle, as with universal-type gear ring. The use the plurality of combat platforms provides the advantage of doubling the amount of armament which may be deployed simultaneously. It should be understood that the freedom of movement of the two independently operated combat platforms and elevated mechanisms allows for more effective combined or separate deployment of the armament and equipment carried on the combat platforms against ground to aerial targets in the same or different directions and distances.

In this way advantages accrue inasmuch as conventional combat vehicles, especially armored ones, can now be re-equipped, without any problems and in a very short time, with modern elevating combat platforms which in turn enables them to carry accurate fire power deep into enemy territory and thus substantially increase their defensive capability, without diminishing their ability for conventional deployment. Furthermore, this armament set is comparatively low cost thus helping to promote the military and commercial requirement for supplying the defense forces with reasonably priced, simple to operate but highly effective defensive weapons systems against massive attacks from tanks and aerial targets.

It is understood that the elevating height for the platform of a simple armament set cannot be chosen as great as for the wellknown highly specialized vehicles. This is the reason why it is recommended to locate especially the visionics IE. the electronic-optical systems for spotting and tracing of enemy targets as well as for guiding of missiles, on a separate elevating mechanism in order to achieve better depth of penetration and improve on the cover for the combat vehicle.

BRIEF DESCRIPTION OF THE DRAWING

Apparatus in body and features of our invention are depicted in the accompanied drawings which form a part of this disclosure and wherein:

FIG. 8 is a planned view of the combat vehicle with an extendible telescope system joined omni-directionally to the front thereof and showing a gear boom for mounting a secondary combat platform;

FIG. 9 shows armament sets which may be carried on the deck of the vehicle;

FIG. 10 illustrates armament sets which are mounted on the rear of the combat platform.

DESCRIPTION OF PREFERRED EMBODIMENT

Figures 1, 2, 3, 4:
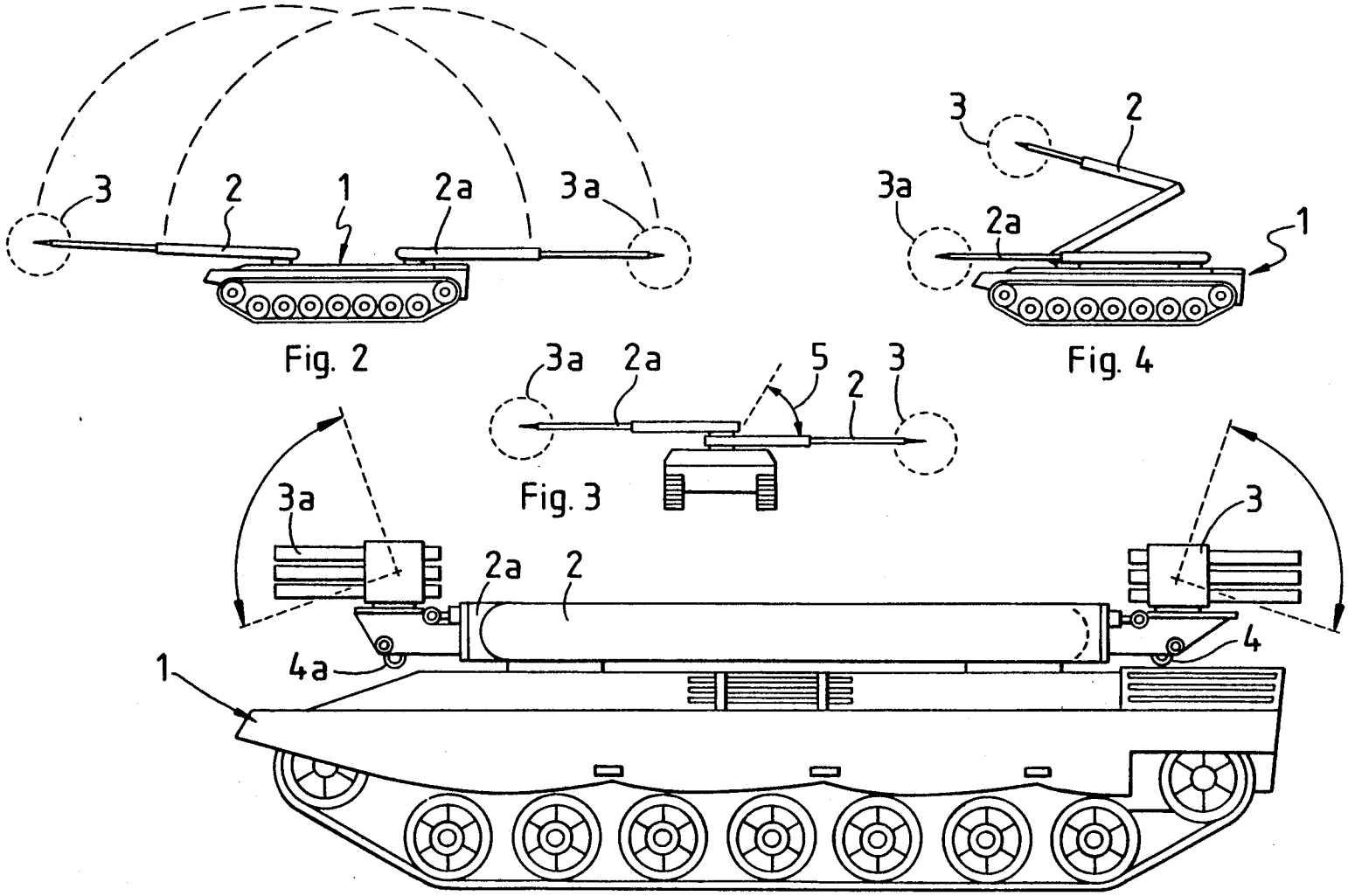
FIG. 1 is a side elevational view of a combat vehicle having a set of extendible arms with a platform position formed thereon.
FIG. 2 is a side elevational view showing the range of deployment of the arms shown in FIG. 1.
FIG. 3 is a front elevational view of the combat vehicle shown in FIG. 1 showing the lateral extent of deployment of the combat platforms.
FIG. 4 is a side elevational view of a combat vehicle wherein the elevated arms are folding or hinged-typed arms.

Referring to the figures for a better understanding of my invention it will be seen in FIG. 1 that I make use of a standard tank chassis indicated by the numeral for mounting two telescoping folding arms 2 and 2*a* with a combat platform 3 and 3*a* at the respective upper end of each folding arm. These telescoping arms are extension members and are swivel jointed on the bottom to the deck of the tank chassis and pivot upwardly proximal the swivel joint. It thus may be seen that combat platforms so mounted may be extended in all directions and may be held in any intermediate position for deployment. It is envisioned that each combat platform and its elevating member 2 or 2*a* will be operated by its own crew member with all movement being indicated on screens internally of the vehicle which are not shown in the enclosed drawings. It is to be understood that an internal system, preferably computer based, will be utilized to monitor the position of the extension members and combat platforms at all times to provide a safety lockout for both movement of the combat platforms as well as the firing of any weaponry associated therewith such that the combat platforms do not inadvertently endanger its counterpart on the vehicle.

Figure 5A:
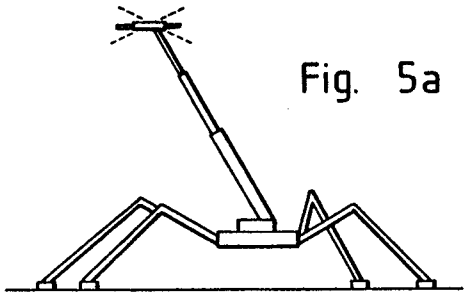
FIG. 5*a* shows the deployment of one of the extendible combat platforms from the vehicle onto a ground mount.
Figure 5B:
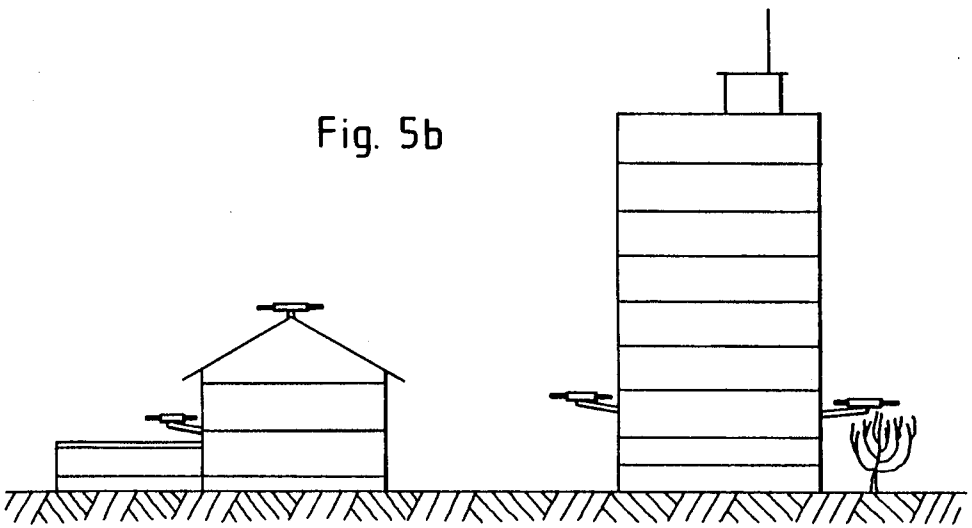
FIG. 5*b* shows the deployment of the vehicle in combat platform behind buildings.
Figure 11:
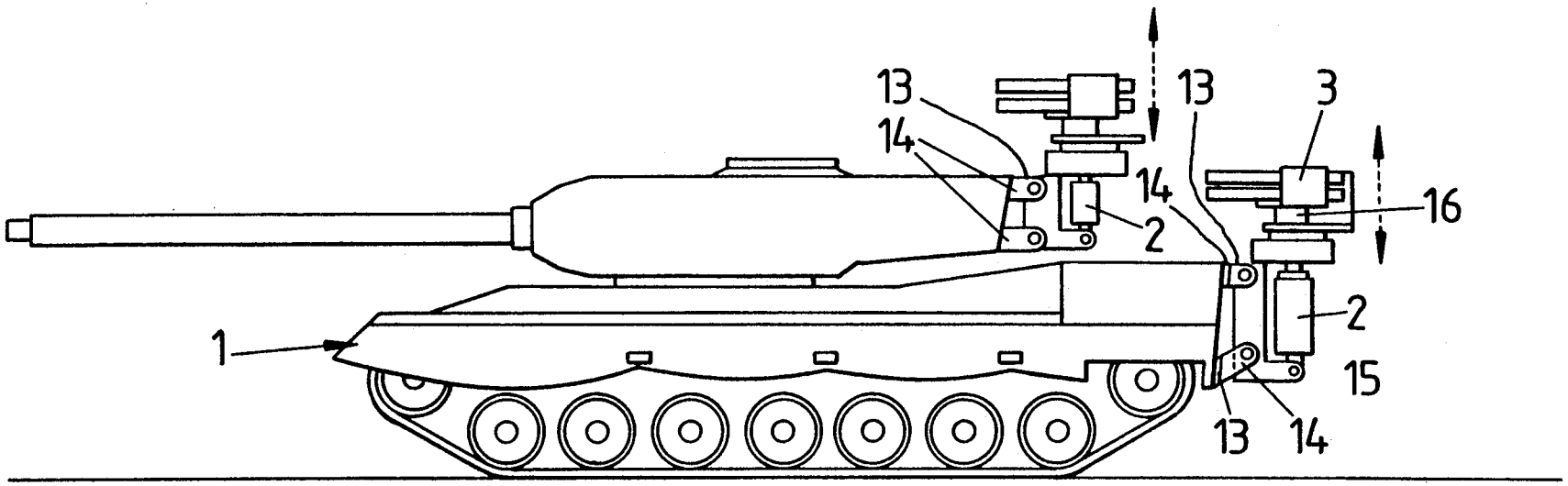
FIGS. 11–13 show armament sets developed for conventional combat vehicles which may be utilized with such vehicles for rearming and modernization thereof.
Figure 12:
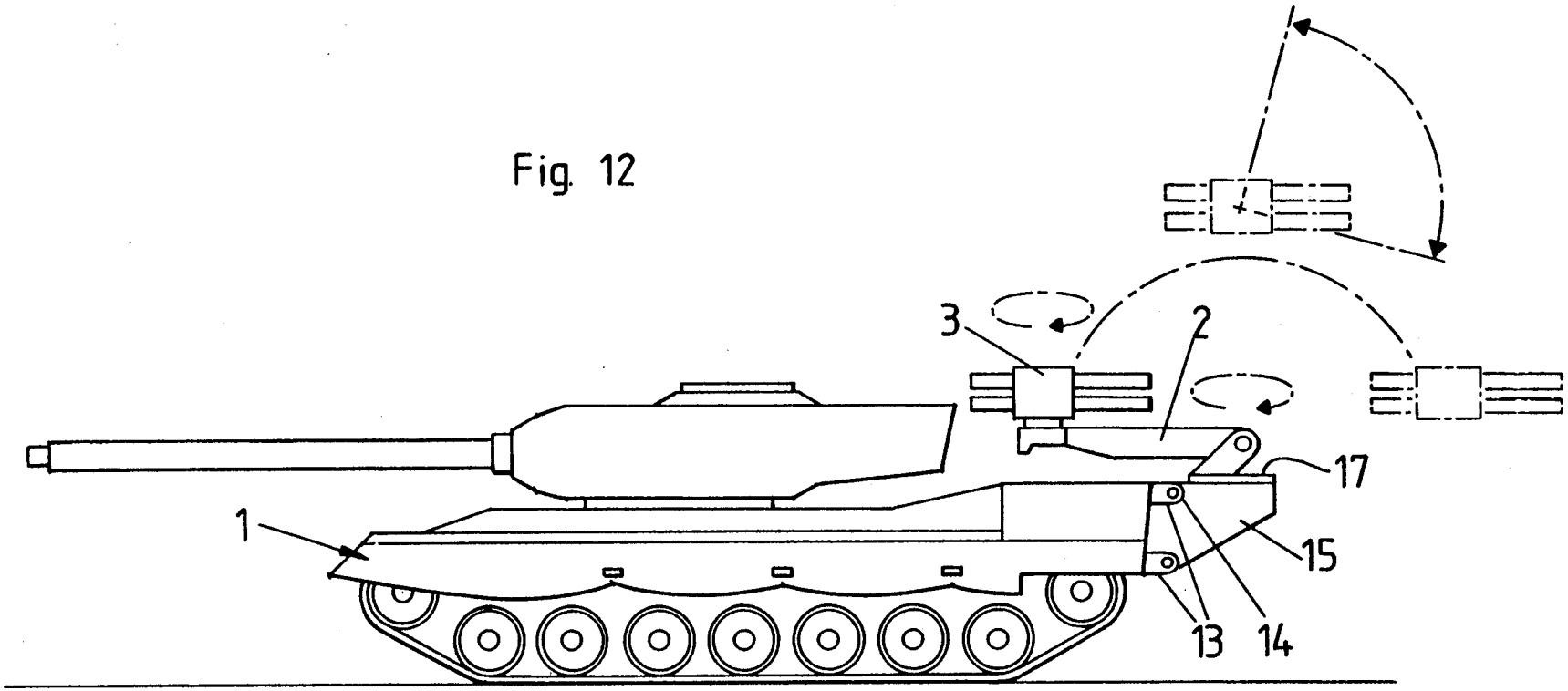
Figure 13:
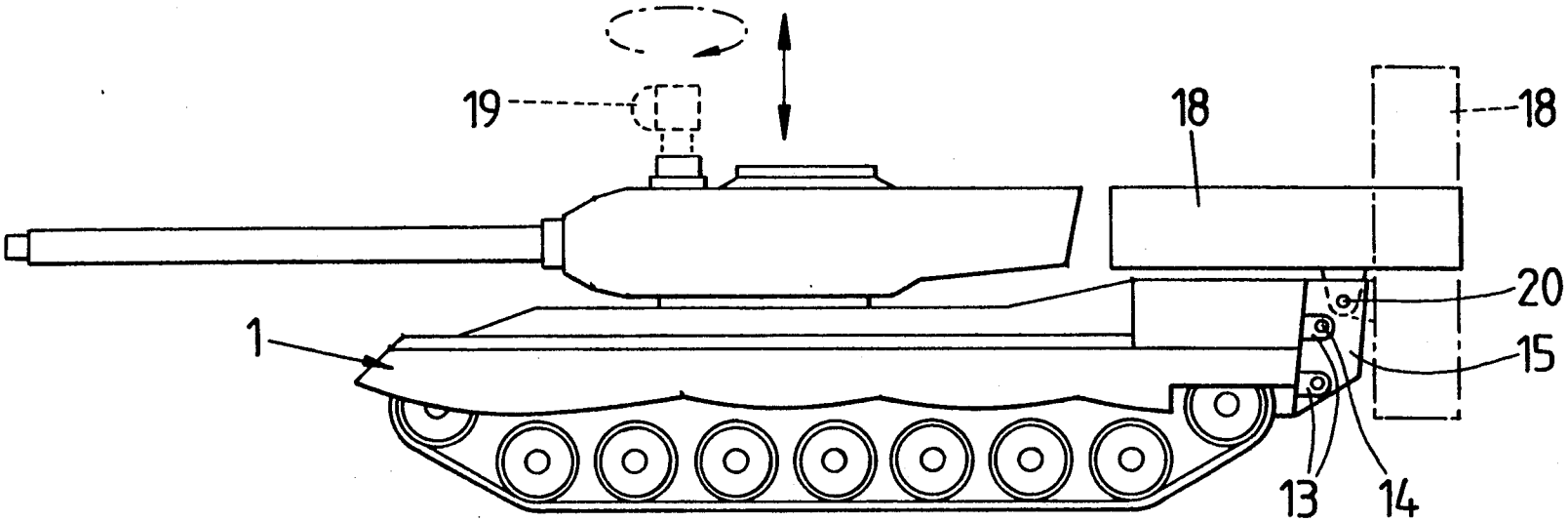
Figure 14:
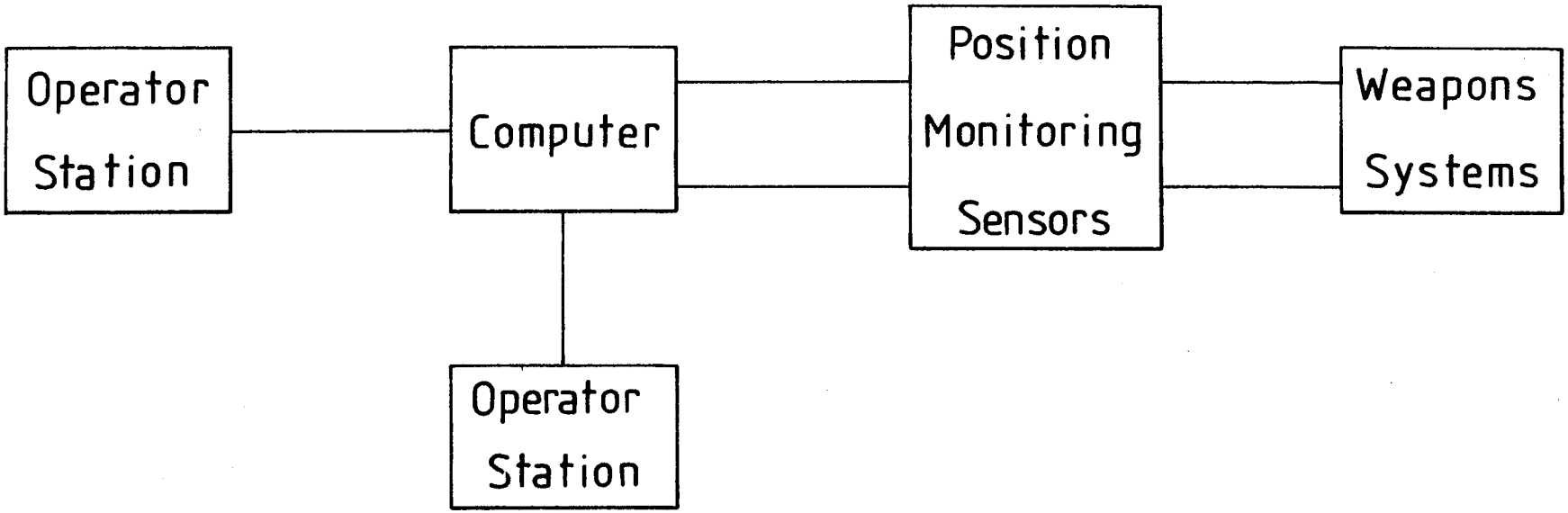
FIG. 14 is a block diagram of the control system for the weaponry.

It will be appreciated that the independently movable unmanned combat platforms 3 and 3*a* are able to rotate 360 degrees about a vertical axis and are able to tip from −20 degrees to +70 degrees relative to the horizontal. It is contemplated that an automatic leveling system, of the well-known Gyroscopic type or any other conventional type will be utilized to keep the combat platforms in a normally level position, subject to manual override or an override occasioned by aiming of the combat platform at a particular target. The weaponry and other equipment loaded onto the combat platforms 3 and 3*a* may include a variety of guided missiles, light automatic weapons, video-optics, sensors for daylight or night-usage as well as transmitter, computer, and alarm systems. Several of these embodiments are shown in FIG. 11–13. It is further contemplated that both combat platforms are to be fully operational when the vehicle is moving as well as when the vehicle is at rest. It will also be appreciated that the extension members may serve as booms whereas loads hanging members 4 and 4*a* can be utilized to attach material to the boom for lifting and maneuvering. Referring to FIG. 2 it may be seen that the apparatus as shown in FIG. 1 has a full range of extension turning and swiveling for both elevated mechanisms. From FIG. 2 it may be clearly seen that the extensions 2 and 2*a* are telescopic members which extend well beyond the end lines of the vehicle. Weapons and equipment mounted on combat platforms 3 and 3*a* can thus be effectively deployed around houses or street corners by the crew including the driver in the vehicle and may be behind cover as shown in FIG. 5*b*.

FIG. 3 shows that the extension members are equally movable at the lateral range thus from FIGS. 2 and 3 it is evident how both telescopic members 2 and 2*a* may be used to balance the system's weight and increase stability without sacrificing deployability of the system. Therefore, all conceivable intermediate positions within the pivoting and swiveling range of both extension devices should be considered in connection with the terrain usage. As may be seen from FIGS. 5*d* and 5*e* the advantages rapidly accrue when light and highly maneuverable forms of this invention are used in extreme terrain wherein the vehicle itself may take cover while exposing the combat platforms for reconnaissance or fire control. FIG. 3 also shows telescope extender used as an elevating means for combat platforms with the booms mounted one on top of the other with the upper swivel joint of the lower boom positioned outside the common pivot axis of the elevating mechanisms. In this manner mutual obstruction of movement is greatly reduced and for this type of mount the centrally located turret gearing on existing vehicles may be used here.

Figure 5C:
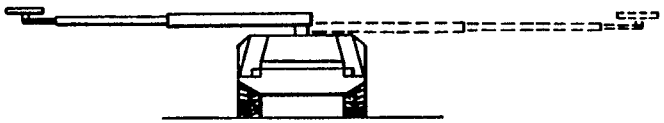
FIG. 5*c* depicted a wheel-driven fast-moving armored car with two elevated mechanisms mounted one above each another which are shown extended horizontally with light combat platforms thereon.
Figure 5D:
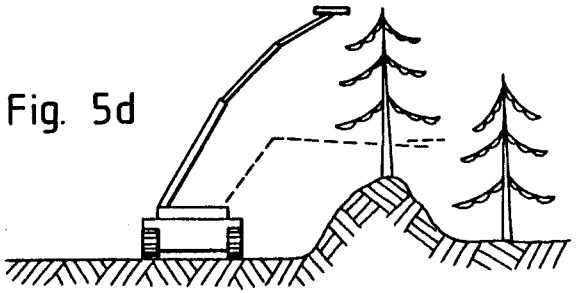
FIG. 5*d* and 5*e* illustrate typical examples of deployment of the invention in combat terrain.
Figure 5E:
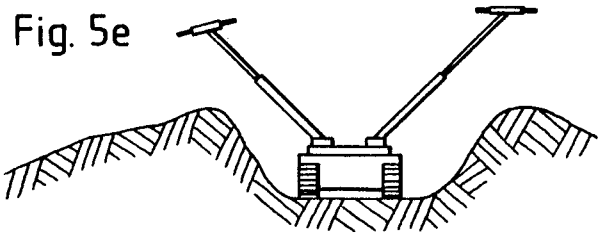
Figure 6:
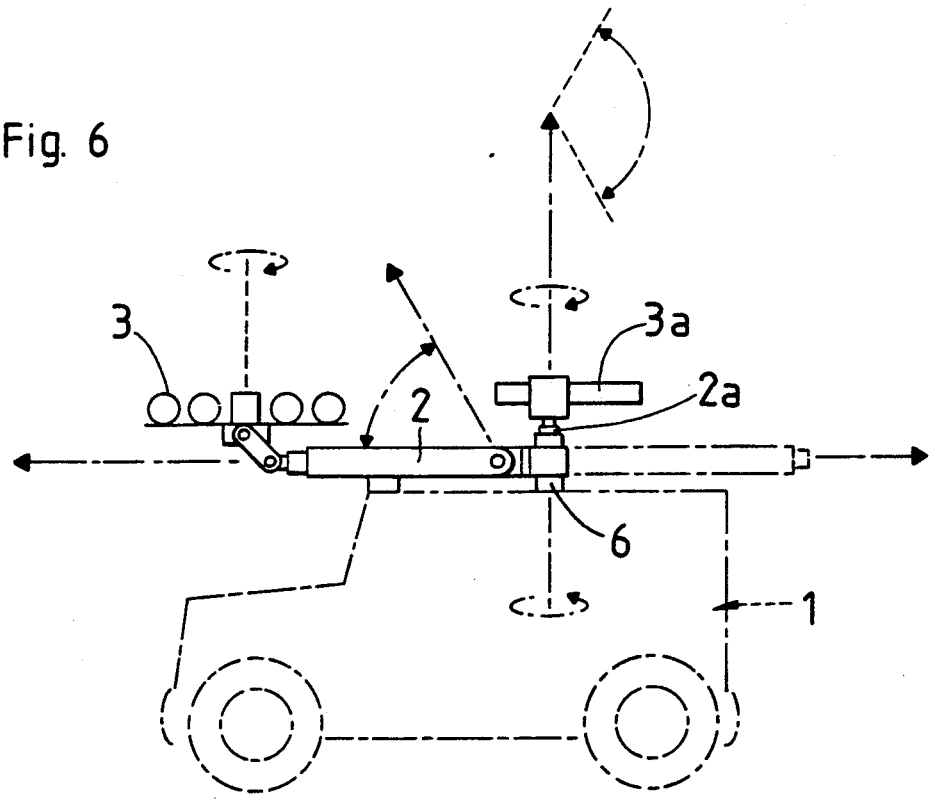
FIG. 6 shows an embodiment of the invention wherein one combat platform is mounted on a telescope and pivotially mounted boom and a second combat platform is mounted on a vertically movable platform.

Referring to FIG. 4 it may be seen that extension member 2 is a folding boom which is swivel jointed to the deck and extension 2*b* is a folding extension boom swivel mounted at the opposite corner of the deck of the vehicle. It will be appreciated that the mechanism 2 or 2*a* can be replaced by a separate light elevating mechanism with combat platform, the entire assembly being latched and removable from the vehicle rather than permanently mounted thereto. FIG. 5*a* is a representation of such a light elevated mechanism displaced from the vehicle onto the ground. It will be appreciated that with this type of platform and extension a plurality of such devices may be mounted on a vehicle using one of the devices as the mechanisms for loading and unloading the other device. FIG. 5*c* shows a wheel-driven fast-moving armored car with two elevated mechanisms mounted one above each other and extending horizontally and sideways with light combat platforms thereon, each furnished with such weaponry as guided missiles, light automatic weapons, or spraying equipment. FIG. 6 shows yet another embodiment of my invention wherein a combat platform 3 is mounted on a pivoting and swiveling telescope extension member 2 as in FIG. 1 with a second combat platform 3*a* mounted on a vertically extendible linear actuator 2*a* which is suitable only for vertical lift but is separately movable from the extension member 2. Both extension members 2 and 2*a* are joined to the vehicle 1 through a short rotating mast 6. This mounting arrangement of the second platform is favored in embodiments where light automatic weapons are used, for example—for installation on light highly mobile vehicles such as jeeps with a relatively light load carrying capability.

Figure 7:
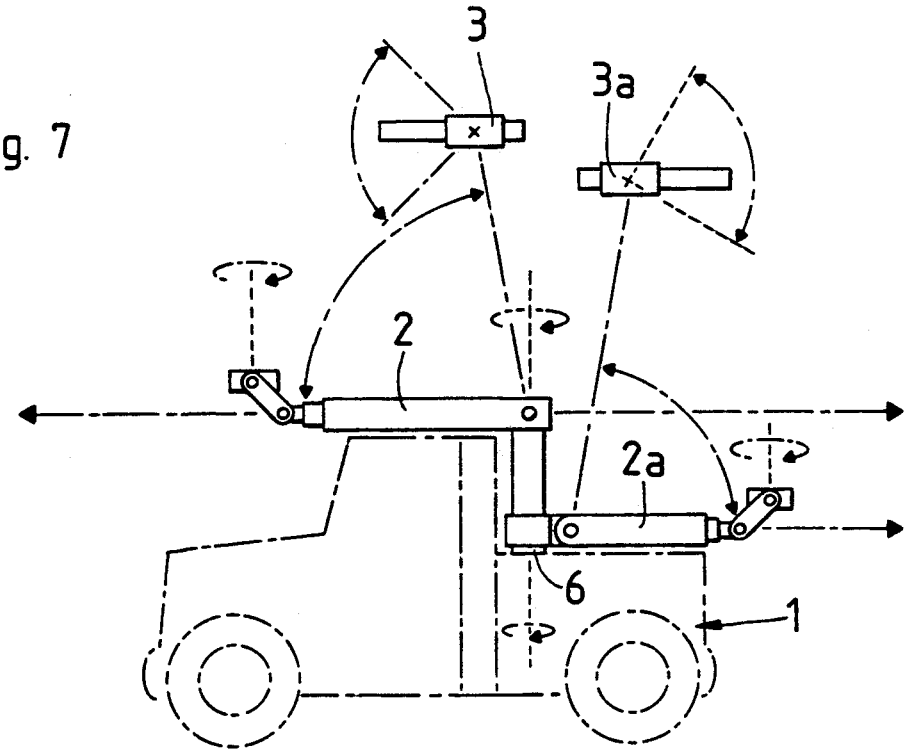
FIG. 7 shows a varied embodiment mounted on a light weight vehicle utilizing two telescoping swing arms.

FIG. 7 also shows another variant utilizing two telescoping and swing arms, with the upper telescoping and swing arm 2 mounted for motion above the cab of the underlying vehicle in a form of a truck while the second swing arm 2*a* is mounted for pivotal and rotational movement from the bed of the truck behind the cab. Referring to FIG. 8 it may be seen that a combat vehicle 1 has mounted thereon an extendible telescope system 2 for omni-directional movement about a vertical axis near the left front end of the vehicle. The extendible telescope system is equipped with twin combat platforms 3 and a radar 7. A secondary lifting mechanism and combat platform could be mounted in a conventional turning gear 10 on the vehicle deck 11 or on the rear at 12. The armament set which may be mounted at the deck 12 of the vehicle 1 is depicted more clearly in FIG. 9 and as may be seen more clearly in FIG. 11, the armament set is provided with supports 13 and 14 which may be disengagable from the vehicle 1. It would be appreciated that the armament set shown in FIGS. 11–13 have been developed for conventional combat vehicles and are to be used in the rearming and modernization of such vehicles. These armament sets will considerably increase the capability of these vehicles and significantly reduce the time required to utilize the armament systems. In FIG. 11 it may be seen that the vehicle 1 includes a turret whereon a conventional turret gun is mounted and to which a armament set consisting of an elevating mechanism 2 and a combat platform with armament 3 is mounted to the rear of the turret while a second identical set is mounted to the stern. The armament set 15 includes a turning and tilting device 16 for the combat platform. In FIG. 12 the turret vehicle 1 is again shown with a stern armament set including a pivoting extension member 2 and a combat platform 3 which is rotatable about the upper end of the extension member. The stern armament set is mounted in a rotatable ring mounting 17 and also has a pivot mounting to vary the elevation thereof. In FIG. 13 a container 18 is mounted on a pivot 20 in the same manner as the combat platform and extension members shown in the previous embodiments. It will be appreciated that the armament set shown in FIG. 12 with its omni-directional and telescoping elevating mechanism allows for unimpeded turning of the turret with the cannon thus permitting favorable deployment of its combat platform around vertical border lines of protective covers available in the terrain. The container 20 shown in FIG. 13 may carry rockets, fuel, fire-fighting- or decontamination-liquids or jamming equipment against detection or guided projectiles and is suitable for deployment. The size and form of the container may be adjusted to combat requirements and dependent on circumstances, the target and guidance system of the combat vehicle 1 can be supplemented or an additional system 19 mounted on an extension member similar to the combat platforms may be carried on board and raised to desired elevation. The present invention further contemplates extension members capable of conducting air through a closed system from the free end of the extension members to with the vehicle. These extension members would provide air to the crew and engines of the vehicle should the vehicle become submerged in water. From the foregoing it may be seen that I have described a plurality of various embodiments of my invention which include a combat vehicle with two elevated mechanisms and combat platforms which can be deployed independently from each other and which are capable of combat with several aerial and ground targets simultaneously in different directions and at different ranges. It should be appreciated that the vehicle carrying my combat armaments may be effectively hidden behind available cover thus exposing only the armaments only to hostile fire. An additional advantage to this invention relates to the elevation of more than one elevating mechanisms with combat platforms which are extendible into all directions and allows for a multiple immediacy deployment of armament.

What I claim is:

1. In combination with a ground combat vehicle having a plurality of crew stations therein the improvement comprising at least two independently controllable elevating members supported on said vehicles at mutually balancing locations for controlled movement in azimuth and elevation from said plurality of crew stations with each elevating-member supporting an independently controllable combat platform including selected armament and electronic observation devices which are controllable and usable from said crew station, and computer means for monitoring and displaying the position of said elevating means and said weapons system to prevent interference and damage to said weapons system and said elevating means, said computer means including a programmable computer programed to disable said weapons systems or said elevating means to prevent interference or damage thereto, whereby said elevating members are supported on said vehicles for simultaneous complementary deployment of said associated combat platform against one or more aerial or ground targets regardless of relative direction between said targets and said vehicle.

2. The improvement as defined in claim 1 wherein said elevating members are selected from the class of telescoping boom members, folding boom members, or combination folding and telescoping boom members.

3. The improvement as defined in claim 1 further comprising means detachably affixed to said elevating members for loading or unloading material therewith.

* * * * *